US006286938B1

(12) United States Patent
Okano et al.

(10) Patent No.: US 6,286,938 B1
(45) Date of Patent: Sep. 11, 2001

(54) INK JET RECORDING HEAD AND INK JET RECORDING APPARATUS

(75) Inventors: Mamoru Okano; Seiji Yonekura; Yoshinobu Fukano; Shigetaka Fujiwara; Atsushi Onose, all of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/505,624

(22) Filed: Feb. 16, 2000

(30) Foreign Application Priority Data

Feb. 17, 1999 (JP) ..... 11-038168
May 21, 1999 (JP) ..... 11-141970

(51) Int. Cl.[7] ..... B41J 2/06
(52) U.S. Cl. ..... 347/55; 347/40
(58) Field of Search ..... 347/55, 54, 44, 347/20, 89, 42, 12, 13, 40

(56) References Cited

U.S. PATENT DOCUMENTS 4,810,111 * 3/1989 Sogami et al. ..... 400/120
5,160,945 * 11/1992 Drake ..... 347/42
5,400,061 * 3/1995 Horio et al. ..... 347/55
5,754,200 * 5/1998 Minemoto et al. ..... 347/55
5,781,203 * 7/1998 Uriu et al. ..... 347/9
5,801,730 * 9/1998 Shima et al. ..... 347/55
5,889,537 * 3/1999 Shimada ..... 347/41
6,074,044 * 6/2000 Suetsugu et al. ..... 347/55
6,158,844 * 12/2000 Murakami et al. ..... 347/55

FOREIGN PATENT DOCUMENTS

56167475 A * 12/1991 (JP) ..... 347/55

* cited by examiner

*Primary Examiner*—John Barlow
*Assistant Examiner*—Blaise Mouttet
(74) *Attorney, Agent, or Firm*—Antonelli, Terry, Stout & Kraus, LLP

(57) ABSTRACT

An ink jet recording apparatus has a head substrate, a jetting member disposed on the substrate, a recording electrode disposed so as to sandwich the jetting member and for making ink jet from the jetting member, and a separating wall for covering the recording electrode, wherein the ink is supplied from the proximal end of the jetting member and recovered in an upward direction from near the tip end of the jetting member. According to such an arrangement, it becomes possible to prevent the recording electrode from being clogged with ink adhering at the tip end thereof, and thus, the locus of the ink drop jetted from the head can be prevented from being deviated due to deviation of the jetting point on the jetting member. Accordingly, it becomes possible to provide an ink jet recording apparatus which is capable of printing an image with a high definition.

6 Claims, 14 Drawing Sheets

FIG. 15A(1)
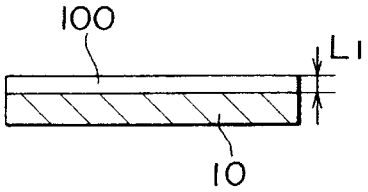
FIG. 15A(2)
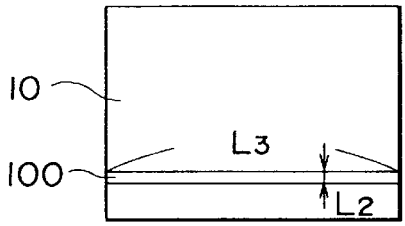
FIG. 15B(1)
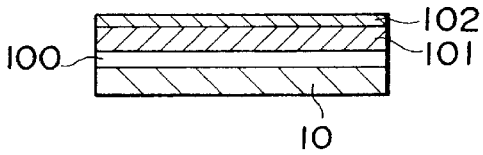
FIG. 15B(2)
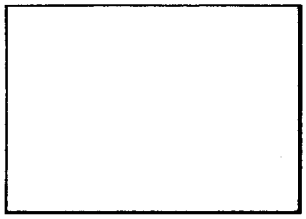
FIG. 15C(1)
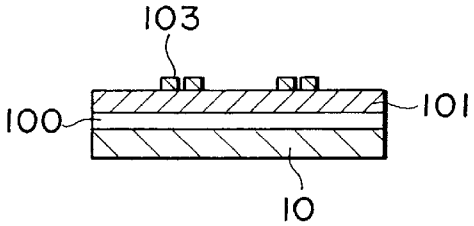
FIG. 15C(2)
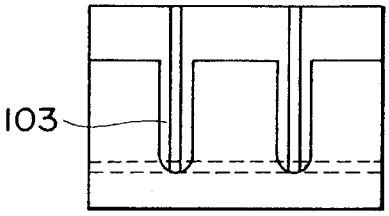
FIG. 15D(1)
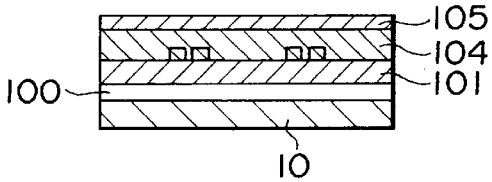
FIG. 15D(2)
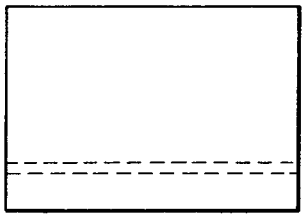
FIG. 15E(1)
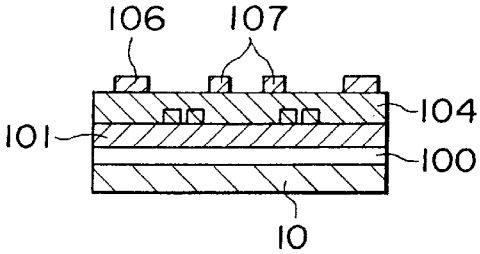
FIG. 15E(2)
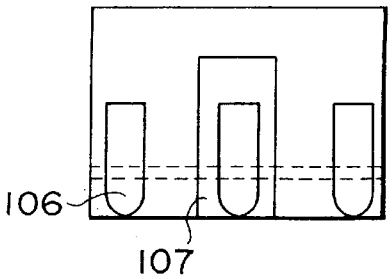

FIG. 15F(1)
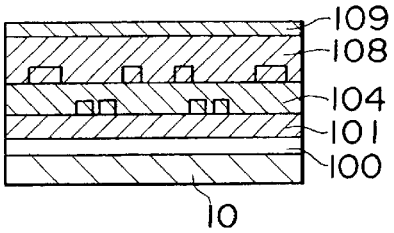
FIG. 15F(2)
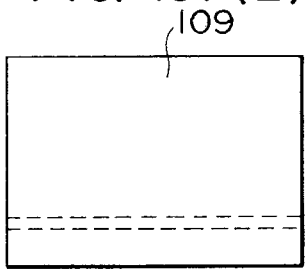
FIG. 15G(1)
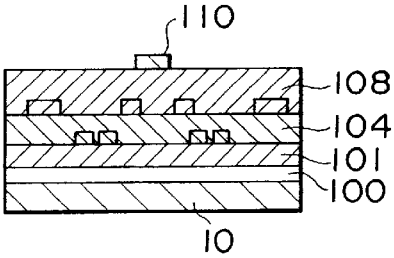
FIG. 15G(2)
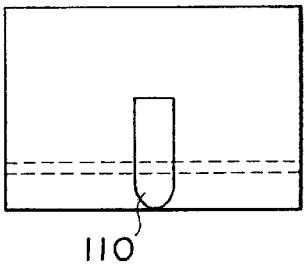
FIG. 15H(1)
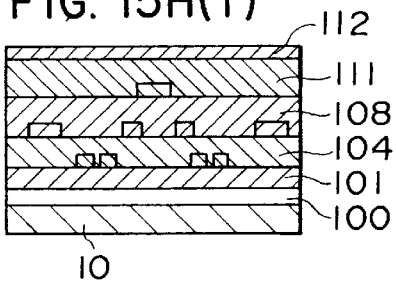
FIG. 15H(2)
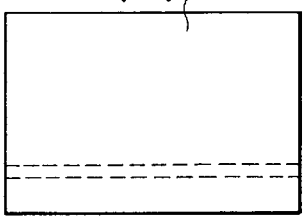
FIG. 15I(1)
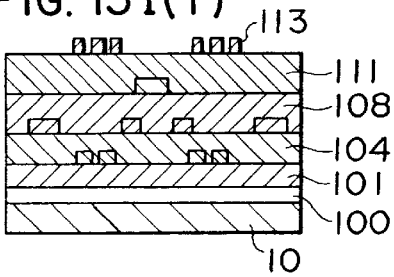
FIG. 15I(2)
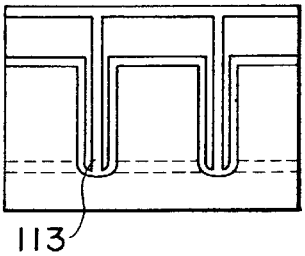
FIG. 15J(1)
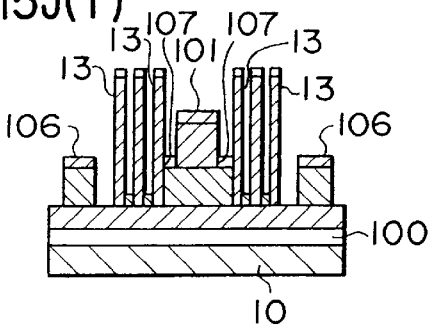
FIG. 15J(2)
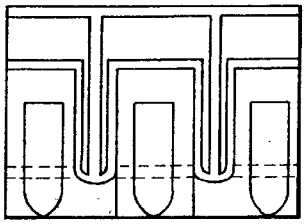

FIG. 15K(1)
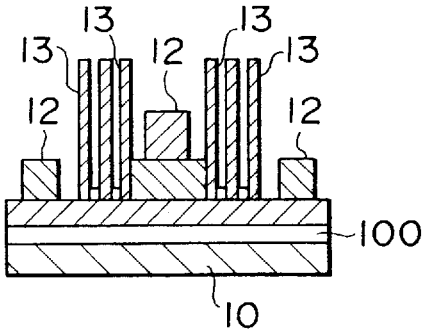
FIG. 15K(2)
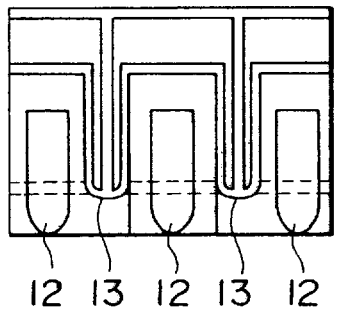
FIG. 15L(1)
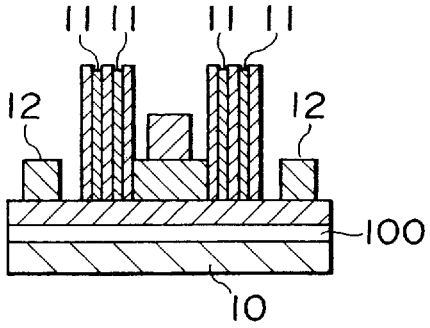
FIG. 15L(2)
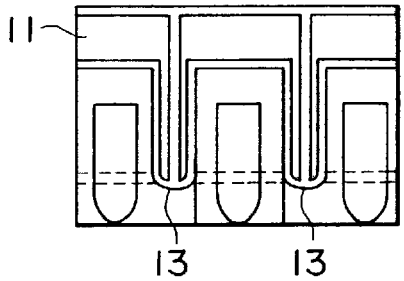
FIG. 15M(1)
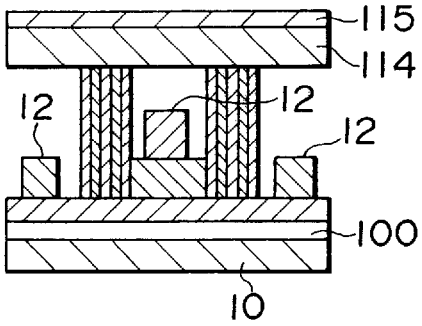
FIG. 15M(2)
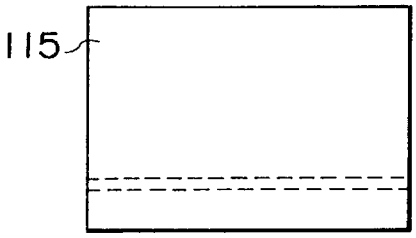
FIG. 15N(1)
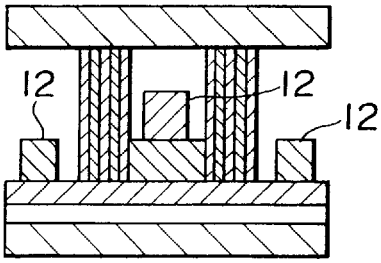
FIG. 15N(2)
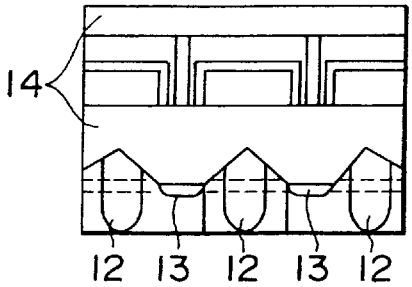

INK JET RECORDING HEAD AND INK JET RECORDING APPARATUS

BACKGROUND OF THE INVENTION

The present invention relates to an ink jet recording apparatus in which ink drops are jetted from an electrode of a recording head toward a recording medium, thus recording an image on the recording medium.

As one type of ink jetting operation of an ink jet recording apparatus, which is utilized for directly jetting ink drops from a minute ink jetting unit toward a recording medium for forming dots on the recording medium, there is an electrostatic recording system in which the ink drops are drawn by an electrostatic force. According to the electrostatic recording system, it is possible to control the ink jetting amount by subjecting the voltage applied to the recording electrode to a pulse width modulation. Thus, this system has attracted attention as a system for use in a high definition ink jet printer.

As one example of this type of system, WO-A-9311866 discloses a method in which ink composed of a solvent with a color agent dispersed therein at a low concentration is supplied to a front face of a recording electrode, and the recording electrode is supplied with a voltage to form an electric field, so that the color agent with an electric charge is flocculated, thus densely concentrated ink is jetted from the recording electrode toward the recording medium.

On the other hand, WO-A-9727058 discloses a technology in which ink is supplied to a flow path of L-letter shape, having a square cross-section, the flow path being disposed so that a corner thereof is brought to a position nearest to the recording medium, and an electrode having a linear shape provided in the flow path is supplied with a voltage so as to make the ink fly from the L-letter shaped corner position.

Japanese Patent Laid-open No. 10-52919 and the above-mentioned WO-A-9311866 also disclose a technology in which a color agent flocculated material formed around the tip end portion of the recording electrode during bias voltage application is jetted toward the recording medium by applying thereto a pulse voltage corresponding to image information in a superimposing manner. The technology disclosed in these gazettes does not require use of a jetting device having a nozzle aperture which tends to cause ink clogging. Thus, according to these technologies, it becomes possible to realize an ink jet recording apparatus which has an excellent ink jetting stability.

SUMMARY OF THE INVENTION

The electrostatic recording system disclosed in the above gazettes is a system in which ink is circulated, the recording electrode is supplied with a bias voltage so that ink containing a highly concentrated pigment component is collected at the tip end of the recording electrode, and under this condition, the recording electrode is supplied with a pulse voltage in a superimposing fashion so that the highly concentrated ink is jetted toward the recording medium to form an image thereon. Further, with such an arrangement, the ink jetting unit does not have a small aperture, to thereby prevent clogging of the ink jetting unit.

For this reason, even if a number of recording heads are arrayed in a line, each of the heads will not suffer from the problem of not being able to jet ink at some portions. Thus, it is easy to implement an ink jet recording apparatus having a number of heads arrayed in a line (hereinafter referred to as a line head). It is an advantage of the recording apparatus having a line head arrangement that recording can be accomplished over the entire width of the recording medium at one time, which makes it possible to print at a high speed.

According to the present system, the recording electrode is supplied with a voltage derived from a bias voltage to which a pulse voltage is added in a superimposing fashion, whereby highly concentrated ink is jetted from the ink jetting unit. However, the concentrated ink to be jetted is actually not completely jetted, but a little of the concentrated ink remains at the tip end of the recording electrode upon application of the pulse voltage. If such uncompleted jetting is repeated, the remnant of tip end of the electrode. If ink adheres to the recording electrode at the tip end thereof, then the point at which the electric field is concentrated is deviated, with the result that the direction in which the ink drop flies becomes deviated, causing a distortion of the image formed on the recording medium.

The technology disclosed in the above-introduced gazettes, or WO-A-9311866 and WO-A-9727058, does not consider the problem that ink tends to adhere at the tip end of the electrode. Therefore, it can be said that the disclosed arrangement tends to cause a problem in that the flying direction of the ink drop tends to deviate upon recording, with the result that the picture formed on the recording medium is distorted.

Further, when the technology disclosed in the above-introduced gazettes is applied to a line-type ink jet recording apparatus, an electrical interference (cross-talk) is caused between the adjacent recording electrodes, which also causes a distortion of the picture being formed on the recording medium. For example, when only two neighboring electrodes $A_{i-1}$, $A_i$ of three sequentially arrayed recording electrodes $A_{i-1}$, $A_i$, $A_{i+1}$, are supplied with a pulse voltage, the path of the ink drop jetted from the recording electrode $A_i$ located in the middle of the ink jet array is distorted toward the jetting electrode $A_{i+1}$, due to the influence of the cross talk between the recording electrodes $A_{i-1}$, $A_{i+1}$ on both sides thereof. As a result, a dot is not formed at the desired position on the recording medium, with the result that the picture is distorted similarly to the case caused by the ink adhering problem. Such a problem tends to occur more frequently as the recording electrodes are arrayed on the recording head at a narrower pitch.

However, in order to solve the above problem, even if a member for partitioning the ink is provided between the electrodes, if the recording head has a number of electrodes arrayed at a narrow pitch, the electric field distribution generated around the electrode A will vary depending on whether or not recording is simultaneously carried out at a channel in the vicinity of the channel where the electrode A under recording operation is provided. Conversely, if the recording head is arranged to have a number of recording electrodes arrayed at a wide interval so that variation of the electric field distribution can be suppressed, the recording head cannot provide many dots per unit area on the recording medium, with the result that a new problem occurs in that a picture of high definition cannot be obtained.

The example introduced in WO-A-9311866 has an arrangement having no partitioning member between the electrodes arrayed in a line. Therefore, the electric field distribution in terms of the intensity thereof around the electrode A will vary depending on whether or not a pulse voltage is applied to the recording electrode at a channel in the vicinity of the channel where the electrode A under recording operation is provided. Thus, according to such an arrangement, the paths of the ink drops tend to deviate, leading to a picture distortion problem.

Further, the embodiment disclosed in WO-A-9727058 includes a member for partitioning the ink jetting units from one another. However, there is no point at which the electric field is concentrated within each channel, and hence the jetting point of the ink is uncertain, with the result that the direction in which ink drops fly becomes unstable.

Further, according to the technology disclosed in Japanese Patent Laid-open No. 10-52919, an electrode $A_i$ neighboring the recording electrode $A_i$ under ink jetting operation is brought under a floating condition (grounded condition), whereby the electric field distribution concerning the recording electrode $A_i$ and a symmetric property of the ink meniscus with respect to the recording electrode $A_i$ are maintained. However, this arrangement suffers from repeated high voltage application and cut-off thereof during printing, and hence the voltage control unit of the arrangement is subjected to a heavy duty.

According to the present invention, on the basis of the principle of the present recording system for jetting ink, the ink jet recording apparatus is arranged as follows for solving the above problems.

According to the present invention, there is provided an ink jet recording apparatus comprising a substrate, a jetting member disposed on the substrate, a recording electrode, disposed so as to sandwich the jetting member, for causing ink to jet from the jetting member, and a covering member for covering the recording electrode, wherein the ink is supplied from the proximal end of the jetting member and is recovered in an upward direction from near the tip end of the jetting member.

Further, according to the present invention, there is provided a method for fabricating a recording head of the above-described ink jet recording apparatus, including a step of stacking a plurality of head substrates, each having an array of ink jetting units formed on the surface thereof, so that at least the head substrates adjacent to each other in the vertical direction are shifted from each other in terms of the positions of the ink jetting units across the surface of the ink jetting unit array.

As described above, the present invention provides an arrangement in which the jetting member is covered with a covering member, as well as a method for fabricating the arrangement. According to the above arrangement, the ink flow path can be independently provided, the potential applied to the recording electrode under ink jetting operation can be prevented from influencing a surrounding recording electrode or jetting member through the ink, the electric field distribution at the recording electrode in the channel for the ink jetting operation can be stabilized, and hence ink jetting can be carried out with stability.

Further, the ink flows from the proximal end of the jetting member to the tip end of the recording electrode in each independently separated ink flow path. The flowing ink is recovered by a component which directs the ink at a point before it reaches the flying point toward the proximal end of the jetting member. Thus, concentrated ink material which has failed to be jetted toward the recording material during the ink jetting operation can be recovered at the tip end of the jetting member, and hence the jetting member can be protected from ink adhering on the tip end thereof.

Furthermore, the recording head is composed of multiple steps stacked on one another and is arranged such that the jetting members are disposed in a staggered fashion. Thus, it becomes possible to provide an ink jet recording apparatus which is capable of recording an image at high speed and with a high definition.

BRIEF DESCRIPTION OF THE DRAWINGS

FIG. 1A and FIG. 1B are diagrams showing a cross-section and a front perspective view, respectively, of one embodiment of a recording head of an ink jet recording apparatus according to the present invention, wherein FIG. 1A is a section taken on the line a–a' in FIG. 2;

FIGS. 15A(1) to 15O(1) are sectional views illustrating steps of a method of fabricating the recording head according to the present invention; and FIGS. 15A(2) to 15O(2) are top plan views corresponding to FIGS. 15A(1) to 15O(1), respectively.

DETAILED DESCRIPTION OF THE PREFERRED EMBODIMENTS

Figure 4:
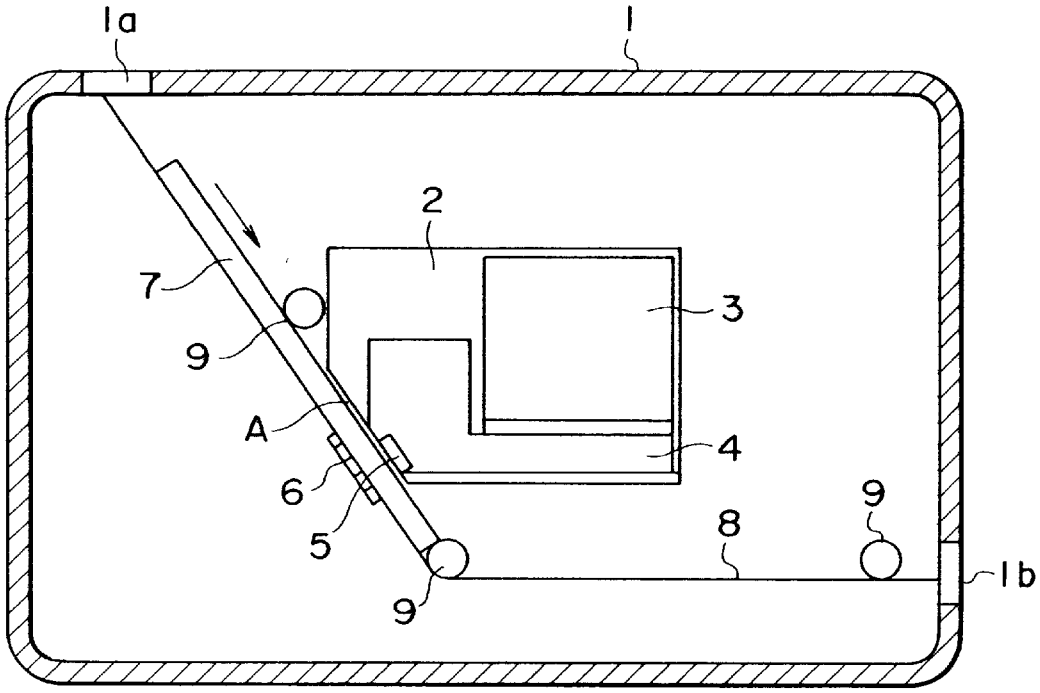
FIG. 4 is a diagram showing an embodiment of the ink jet recording apparatus according to the present invention.

FIG. 4 shows one embodiment of the ink jet recording apparatus according to the present invention. The apparatus includes a housing 1, a recording head 2, an ink tank 3 for supplementing ink to the system, an ink circulating unit 4, an ink jetting unit 5, a common electrode 6, a recording medium 7, a recording medium feeding path 8, and a recording medium feeding unit 9.

In the housing 1 of the ink jet recording apparatus, there are provided the recording head 2 for jetting ink, the common electrode 6 disposed so as to oppose the ink jetting unit 5, the recording medium feeding unit 9 for making the recording medium 7 pass between the ink jetting unit 5 and the common electrode 6, and a controller for controlling the entire system of the apparatus.

The recording head 2 includes the ink tank 3, the ink circulating unit 4 and a number of ink jetting units 5 arrayed at a proper interval on a portion of the ink circulating unit 4. The ink jetting units 5 are arrayed such that the direction of the array thereof is transverse to the feeding direction of the recording medium 7. If the ink jet recording apparatus is capable of color-printing, the apparatus shall be provided with recording heads 2 for at least each color of cyan, magenta, yellow and black.

The recording medium feeding unit 9 is driven by a motor (not shown). The recording medium feeding unit 9 feeds the recording medium 7 on a recording medium feeding path 8 from a recording medium inserting aperture la provided at the upper side of the apparatus to a recording medium discharging aperture 1*b* provided at the lower side of the same. The recording electrode provided in each ink jetting unit 5 of the recording head 2 is ordinarily supplied with a bias voltage of about 1.5 to 2 kV, and further, the recording electrode is supplied with a pulse voltage of about 0.5 kV in accordance with the recording signal. When the recording electrode is supplied with the bias voltage, the ink jetting unit 5 can collect at the tip end thereof a color agent component contained in the ink which is circulated in the ink circulating unit 4. When the recording electrode is supplied with a pulse voltage, the ink jetting unit 5 jets ink from the tip end thereof. When the ink jetting unit jets a drop of ink, the amount of ink retained in the ink jetting unit 5 is decreased. However, ink is supplemented from the ink tank 3. The ink employed in the ink jet unit may be, for example, a petroleum oil-base solvent, such as isoparaffin, having a viscosity of about 1 to 10 mPa·s dispersed with a charged pigment together with a charge control agent. The method for circulating the ink and the arrangement of the ink jetting unit 5 will hereinafter be described in detail.

Figure 5:
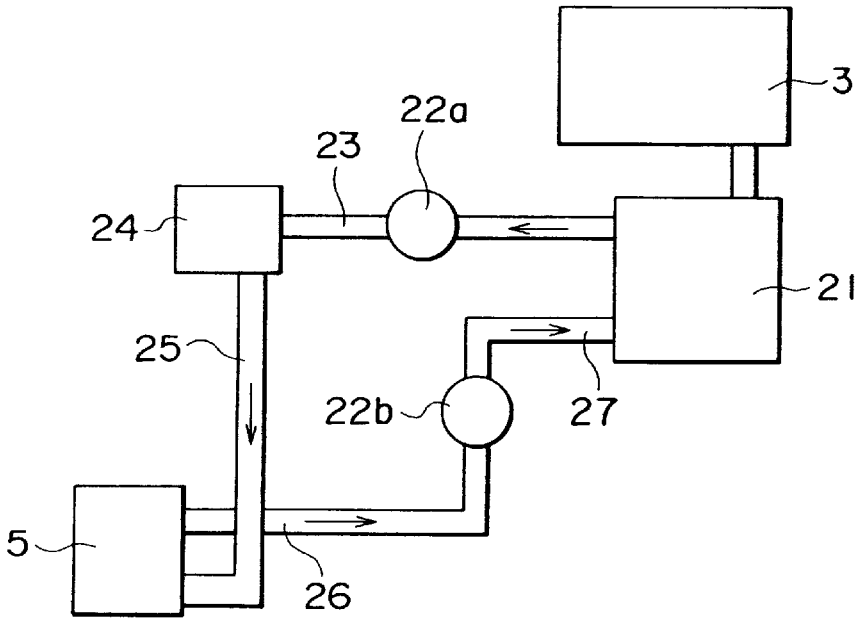
FIG. 5 is a diagram showing an ink circulating system of the ink jet recording apparatus according to the present invention.
Figure 6:
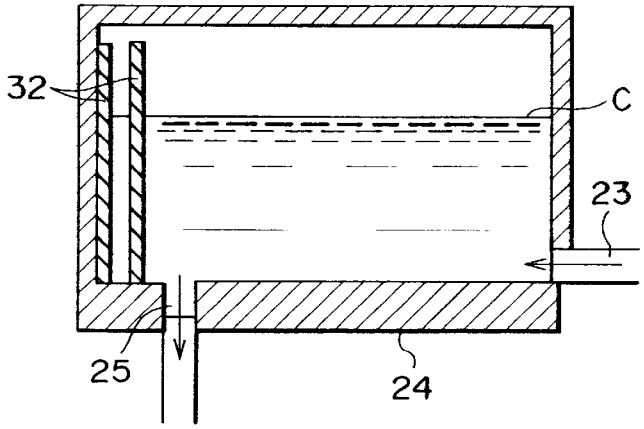
FIG. 6 is a diagram for illustrating an ink pressure adjusting method of the ink circulating system according to the present invention.

Firstly, the ink circulating unit 4 will be described. FIG. 5 is a diagram showing the arrangement of the ink circulating unit 4. The ink circulating unit 4 includes an ink reservoir 21, an ink flow amount adjusting chamber 24, pumps 22*a*, 22*b* controlled by the controller, and conduits 23, 25, 26, 27. The ink flow amount adjusting chamber 24 has, for example, as shown in FIG. 6, an ink level detector 32 disposed within the ink flow amount adjusting chamber 24 for detecting the ink level therein. The detected value thereof is fed back to the controller for controlling the pump 22*a*. The ink circulating unit 4 composed of these components can be divided into two systems: an ink supplying system for supp@y. 'Iri§ ink to the ink jetting unit 5, and an ink recovering system for recovering ink from the ink jetting unit 5. In the ink supplying system, ink stored in the ink reservoir 21 is pumped by the pump 22*a* and sent to the ink flow amount adjusting chamber 24. Further, since the pump 22*a* is driven so that the deviation between the detected value of the ink level detector 32 and a target value can be suppressed to a small value, the ink flow amount adjusting chamber 24 will always have therein a predetermined amount of ink.

Ink supplied to the ink flow amount adjusting chamber 24 is urged to flow toward the ink jetting unit 5 having an array of jetting electrodes, by a pressure derived from a potential energy determined by the difference in level between the ink flow amount adjusting chamber 24 and the ink jetting unit 5. Thus, a constant pressure and proper flow amount can be always obtained.

The ink recovering system recovers ink passing through the ink jetting unit 5 to the ink reservoir 21 by way of the pump 22*b*. Printing is carried out after the ink circulation becomes stable. The ink circulating unit 4 described herein is merely one example of the present invention, and hence another method can be employed so long as a proper amount of ink is supplied to and recovered from the ink jetting unit.

Figure 2:
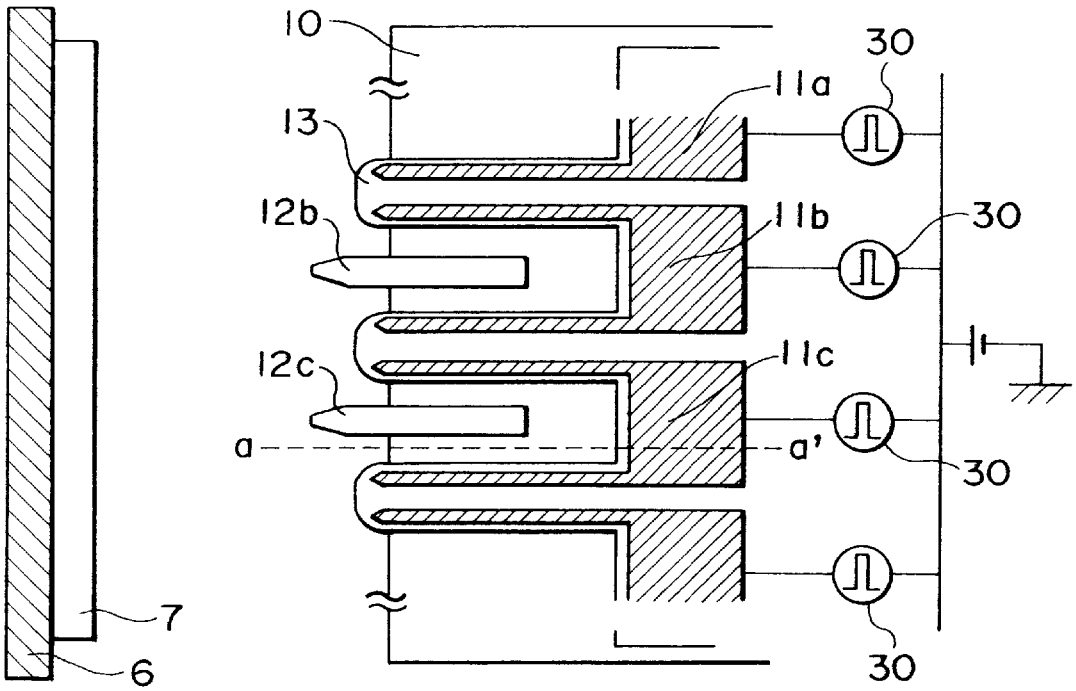
FIG. 2 is a diagram showing a lateral cross-section of the recording head of the ink jet recording apparatus taken on line b–b' in FIG. 1A.

Now, the arrangement of the ink jetting unit 5 will be described. FIG. 2 is a diagram showing an arrangement of the ink jetting unit 5 and surrounding components thereof in the ink jet recording apparatus according to the present invention. On a head substrate 10 made of an insulating material with a low permittivity, such as glass, there are provided jetting members 12*b*, 12*c* each having a convex tip end, and separating walls 13 for separating the jetting members 12*b*, 12*c* from each other to form an ink chamber. The portion serving as the ink chamber is formed into a C-letter shape. In the C-letter shaped portion, the recording electrode 11*b* is formed so as to surround the jetting member 12*b*, for example. Ink is supplied to the region surrounded by the separating wall 13.

When the recording electrode 11*b* is supplied with a pulse voltage from the pulse generator 30 in accordance with an image signal, ink in which pigment components are collected is jetted from the tip end of the jetting member 12*b* toward the recording medium 7. This phenomenon can be explained as follows. That is, the potential applied to the recording electrode 11 propagates through the ink of insulating property, which makes the jetting member 12 also have substantially the same potential as that of the recording electrode 11. Thus, the tip end of the jetting member 12 is made to have the strongest electric field because the end thereof is nearest to the recording medium 7. In this way, ink is jetted toward the recording medium owing to an electrostatic force. Incidentally, if the separating wall 13 is made to be higher than the jetting member 12, ink will flow easily through the ink flowing conduit.

Further, the recording electrode 11 may be positioned in contact with the ink or it may be disposed inside the separating wall 13. However, if the recording electrode 11 is in contact with the ink, the recording electrode 11 may have ink adhere on the surface thereof depending on the property of the utilized ink. If ink adheres on the surface of the recording electrode 11, it will be better for the recording electrode 11 to be provided inside the separating wall 13 so as not to be contacted by the ink. Thus, the recording electrode 11 can be prevented from having ink adhere thereto.

Of the ink supplied to the ink chamber, ink not jetted toward the recording medium 7 is recovered by recovering means (pump) from the jetting position. How the ink is recovered will be described with reference to FIG. 1A and FIG. 1B.

Figure 1A:
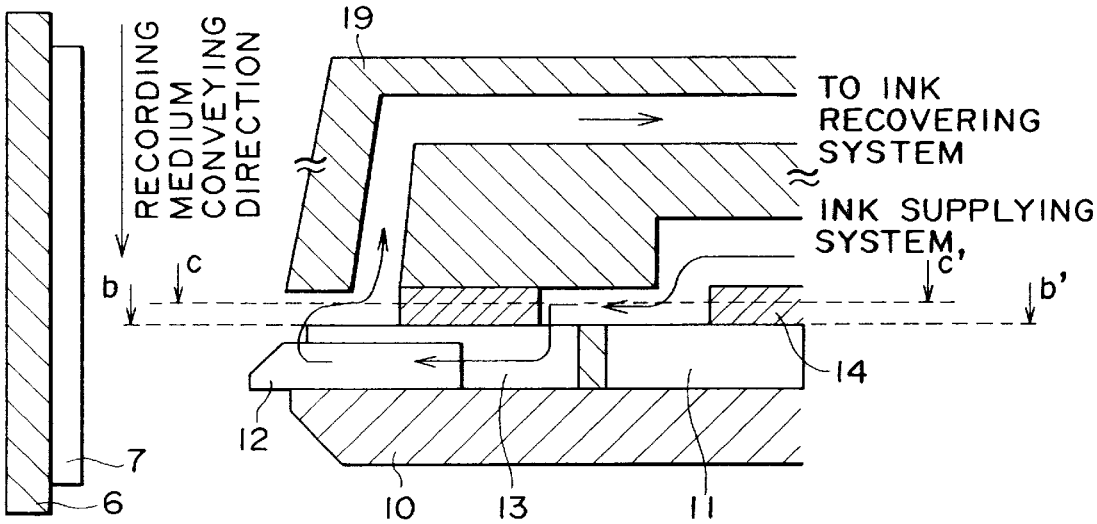
Figure 1B:
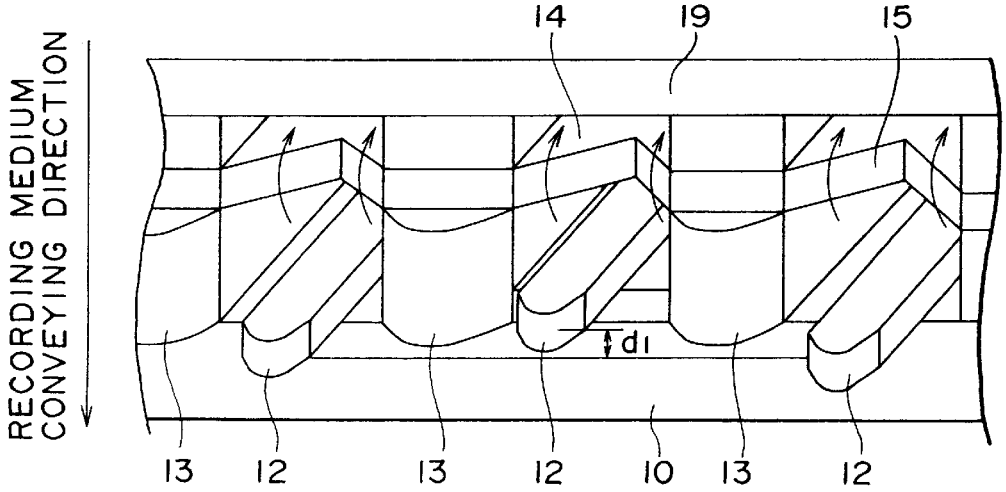

FIG. 1A is a cross-sectional view of the recording head taken along the line of a–a' in FIG. 2 (FIG. 2 is also a cross-sectional view taken along the line of b–b' in FIG. 1A). FIG. 1B is a diagram showing the recording head as viewed from the recording medium 7 and is illustrative of the flow of ink near the ink jetting unit. According to the present embodiment, as shown by arrows in FIG. 1B, ink of a proper amount supplied from the ink supplying unit flows from the proximal end of the jetting member 12 to the tip end of the same, and is recovered in such a manner that the direction of flow is reversed around the tip end of the jetting member. Since the jetting member 12 is sandwiched between the separating walls 13, ink is circulated in each individual region.

Since the ink circulating system is arranged as described above, ink circulation becomes stable and ink can be jetted with stability. Further, the separating wall 13 partly projects from the head substrate 10 by 50 to 250 μm. If the length of the projection is shorter than 50 μm, ink can be jetted from a point on the head substrate 10, which is inappropriate for ink jetting. Conversely, if the length of the projection is 250 μm or longer, the ink under circulation can leak from the head substrate, with the result that a contamination problem is created in the recording apparatus. Further, the jetting member 12 is projected by 20 to 100 μwith respect to the separating wall 13. If the projecting length exceeds this range, the reproducibility of the size of the dot formed by the jetted ink drop will be deteriorated. Why such a problem is caused will be explained with reference to FIG. 11A and FIG. 11B.

Figure 11A:
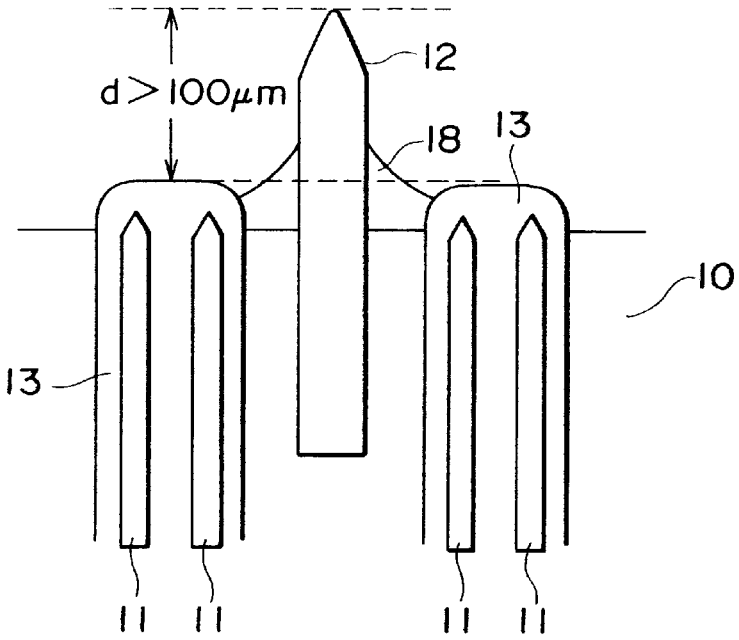
FIG. 11A and FIG. 11B are diagrams for illustrating an ink meniscus formed at the ink jetting unit according to the present invention.

FIG. 11A illustrates an ink curvature shape (hereinafter referred to as an ink meniscus) formed between the tip ends of the jetting member 12 and the separating wall 13 during ink circulation. The ink meniscus 18 is formed due to the surface tension of the ink. The ink meniscus 18 plays a role of leading ink to the tip end of the jetting member 12. FIG. 11A illustrates an ink meniscus formed when the jetting member 12 is supplied with a bias voltage.

When the electrode is supplied with the bias voltage, an electrostatic force is applied to the pigment components within the ink, thereby collecting the pigment components at the tip end of the jetting member 12. If the electrode is further supplied with a pulse voltage corresponding to an image signal, the electrostatic force is increased, thereby to move the pigment within the ink to the tip end of the jetting member 12 together with the ink solvent, thus jetting the pigment toward the recording medium.

Figure 11B:
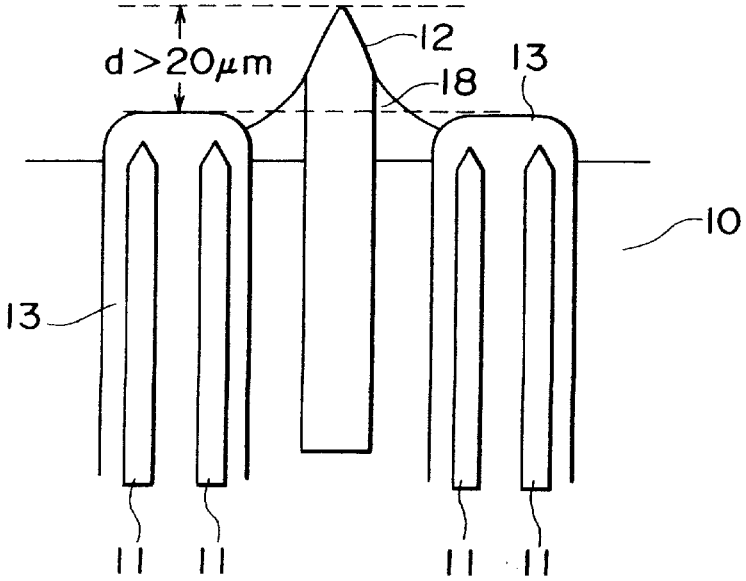

FIG. 11B illustrates an ink meniscus during the jetting of ink. If the distance of between the end of the jetting member 12 and the separating wall 13 is 20 μm or smaller, as seen in FIG. 11B, too much ink is supplied to the tip end of the jetting member 12, causing an excessive amount of ink to be jetted upon application of the pulse voltage, with the result that the picture quality becomes unstable. Further, if the distance of exceeds 100 μm, as seen in FIG. 11A, it becomes hard to supply ink to the tip end of the jetting member 12, thus providing an insufficient amount of ink to be jetted, with the result that the picture quality also becomes unstable.

Now, the motion of the pigment within the ink at the tip end of the jetting member 12 at the time of printing will be described. When the jetting member 12 is supplied with the pulse voltage, in addition to the bias voltage, based on the image information, in a superimposing manner, for jetting ink, the ink meniscus takes the state shown in FIG. 11A from the state shown in FIG. 11B. When the ink is returned to the proximal end of the jetting member 12, concentrated pigment material which remains at the tip end of the jetting member. 12 is recovered together with the circulating flow of ink. This recovering operation is carried out as follows. That is, the ink circulating direction is reversed at around the proximal side of the tip end of the jetting member 12, so that concentrated ink which remains on the jetting member 12 is sucked into the circulating flow from the tip end of the jetting member 12, whereby the jetting member 12 can be prevented from retaining clogging material at the tip end thereof. If some clogging material is adhered on the tip end of the jetting member 12, an ink drop will be jetted from one end of the clogging material, with the result that the path of the ink drop is changed, leading to the problem of distortion of the image. However, according to the above arrangement, the jetting member 12 can be prevented from retaining clogging material at the tip end thereof. Thus, ink drops will fly in a desired direction and, hence, no picture distortion will be experienced.

As described above, the separating wall 13 and the jetting member 12 are arranged to project at the tip ends thereof so that an electric field is concentrated at the tip end of the jetting member 12. Further, since ink is supplied and recovered so that only a desired amount of ink is kept at the jetting point, ink can be jetted by a least possible electrostatic force.

Meanwhile, the recording head of the present invention is arranged to carry out recording while ink is circulated, and ink is recovered by using a pump. Therefore, if the separating wall and the jetting member are designed to relatively project within the range described above, the ink can be jetted in any direction including a range from the vertically upward direction to the vertically downward direction.

Figure 3:
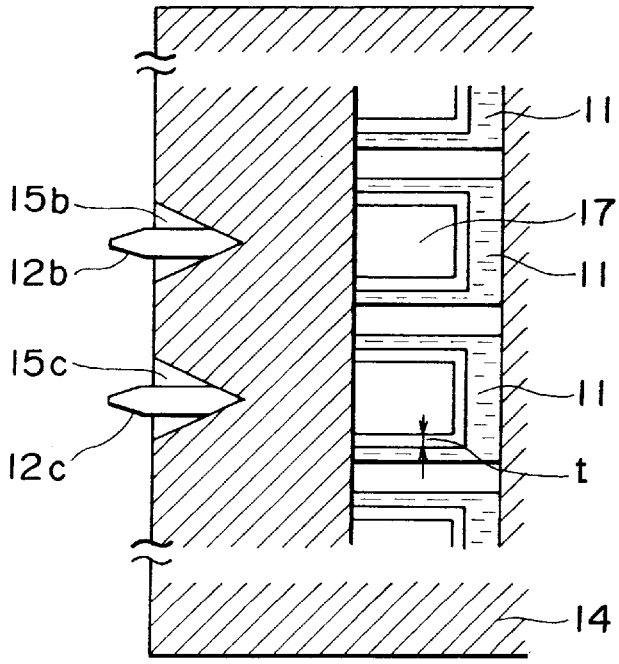
FIG. 3 is a diagram showing a lateral cross-section of the recording head of the ink jet recording apparatus taken on line c–c' in FIG. 1A.

A method for increasing the capability for recovering ink, thus enhancing the above-mentioned effect, will hereinafter be described with reference to FIG. 3, which is a cross-sectional view taken along the line c–c' in FIG. 1A. As shown in FIG. 3, the jetting member 12 and the separating wall 13 are provided on the upper portion thereof with a thin insulating film 14 having an ink inlet 17 and a V-letter shaped notch 15 formed therein. Ink is fed from the ink inlet 17 to the flow path surrounded by the separating wall 13, and then the ink flows along the jetting member 12, for which the insulating film 14 serves as a lid. Ink is recovered from the V-letter shaped notch 15, which is located just above the tip end or in the vicinity of the jetting member 12. The ink will have a large flowing velocity at a portion of the notch where the width of the notch is narrow. Thus, the ink will be efficiently recovered.

An example of a method of fabricating the recording head will be described. Initially, a groove is formed on the head substrate 10 made of glass or the like to about 1 mm thickness, by using a dicing saw. The groove is made to have a width of 0.2 to 0.5 mm and a depth of about 0.2 mm, and also the groove is made to extend in the direction in which the jetting members, each serving as an ink projecting unit, are arrayed. The length of the groove is longer than the lateral width of the line head. This groove is provided for the following reason. When the recording head to be fabricated undergoes all processes that will be described below, another groove will be similarly formed on the opposite side by using a dicing saw. Thus, a part of the head substrate 10 is cut away so that the jetting member 12 is made to project from the head substrate 10.

After the groove is formed on the head substrate 10, a metal film of Al, Ni or the like having a thickness of about 1 μm is deposited on the head substrate 10 by sputtering. Then, a photoresist is coated thereon and the photoresist layer is exposed under light irradiation through a photomask having a desired electrode pattern. Thereafter, the photoresist layer is developed to form a photoresist pattern. Then, an electrode pattern is formed by etching. In this case, the width of the electrode is 10 to 50 μm.

Next, the head substrate 10 has a polyimide film formed thereon to a thickness of about 20 to 50 μm covering the entire surface of the head substrate 10, by using a laminator. As in the case of forming the electrode pattern, a desired separating wall pattern and a guide member pattern are formed by etching by using a photoresist and a photomask. In this case, the width of the jetting member is about 20 to 50 μm, and the interval between jetting members is about 150 to 500 μm. Further, the length of the ink flowing path between the separating wall and the jetting member is about 10 to 50 μm.

Then, the head substrate is dipped into a plating bath of Ni or the like, and electric current is supplied to the electrode pattern to deposit a metal layer thereon by plating up to a height of the separating wall pattern and the guide member. Thereafter, a polyimide film having a thickness of about 20 to 50 μm is again formed by a laminator. As in the aforesaid process, the insulating layer 14 provided with the ink inlet 17 and the V-letter shaped notch 15 is formed by using a photoresist and a photomask. Finally, a groove is formed on the back face of the head substrate 10, so that the groove on the back face opposes to the groove on the front face of the substrate, by using a dicing saw. The head substrate 10 is partly cut away along the grooves and the removed face is ground so as to form a slant face. Thus, the processes of fabricating the head substrate are completed.

A lid 19 with which an ink flowing path is formed is attached to the upper face of the head substrate 10, which is fabricated by the above-described processes. Thus, the head shown in FIG. 1 is completed.

Figure 8:
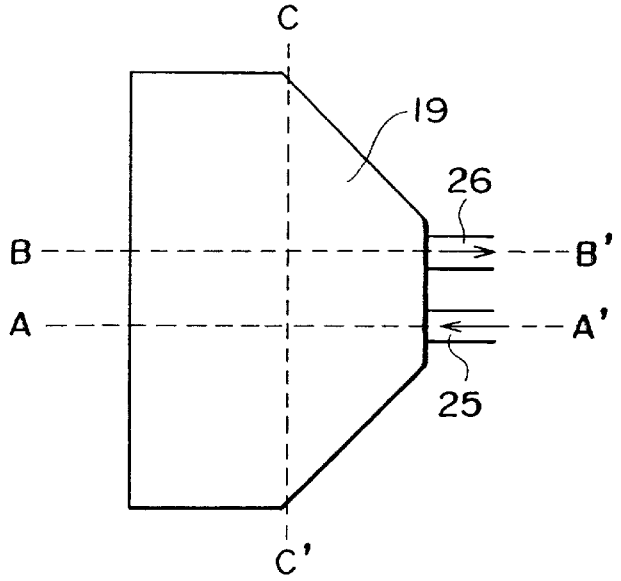
FIG. 8 is a diagram showing an upper face of one embodiment of the recording head of the ink jet recording apparatus according to the present invention.
Figure 9A:
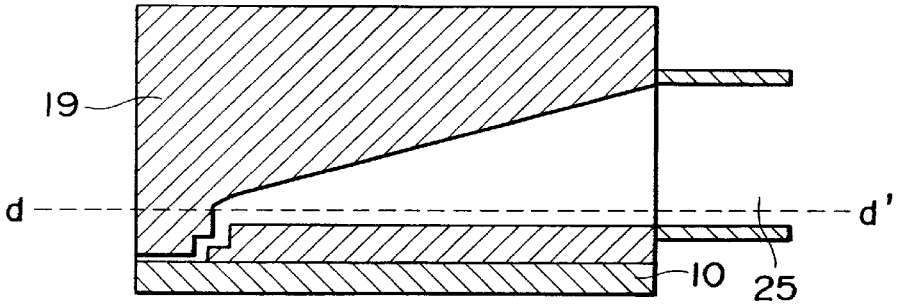
FIG. 9A and FIG. 9 are diagrams each showing a cross-section of one embodiment of the recording head of the ink jet recording apparatus according to the present invention.
Figure 9B:
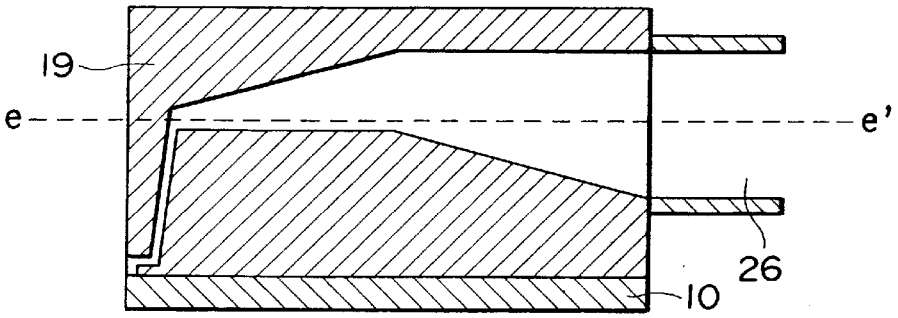

The structure of the lid 19 in which the ink flowing path is formed will hereinafter be described with reference to FIGS. 8 to 10B. FIG. 8 is a plan view of the ink jetting unit 5 as viewed from above the lid 19. The lid 19 is connected with a conduit 25 through which ink is supplied and a conduit 26 through which ink is discharged. FIGS. 9A and 9B show an outline of a portion in which the conduit 25, the conduit 26 and the lid 19 are connected together.

FIG. 9A is a cross-sectional view taken along the line A–A' in FIG. 8 while FIG. 9B is a cross-sectional view taken along the line B–B' in FIG. 8. The inner diameter of each of the conduits 25, 26 is about 2 mm. The ink flowing path within the ink jetting unit is considerably narrower than 2 mm, while the ink jetting unit is wide in the width direction. Thus, the ink flowing path is formed in such a manner that it gradually becomes narrower in the height direction and wider in the width direction. Since the size of the flow path is gradually changed, ink will be circulated without stagnation. Since ink is made to flow without stagnation, the pigment in the ink can be prevented from sedimentation, with the result that the ink circulating device can be prevented from clogging.

Figure 10A:
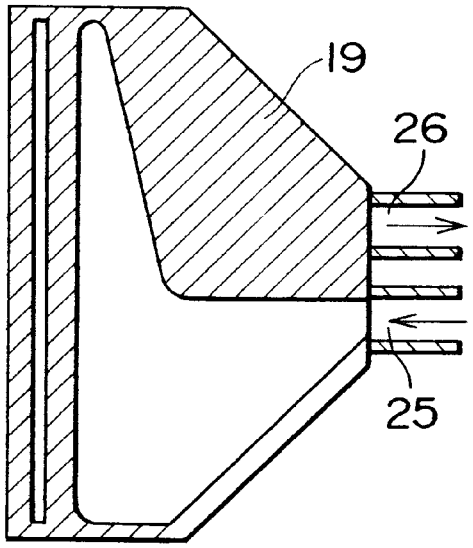
FIG. 10A and FIG. 10B are diagrams each showing a lateral cross-section of the one embodiment of the recording head of the ink jet recording apparatus according to the present invention.
Figure 10B:
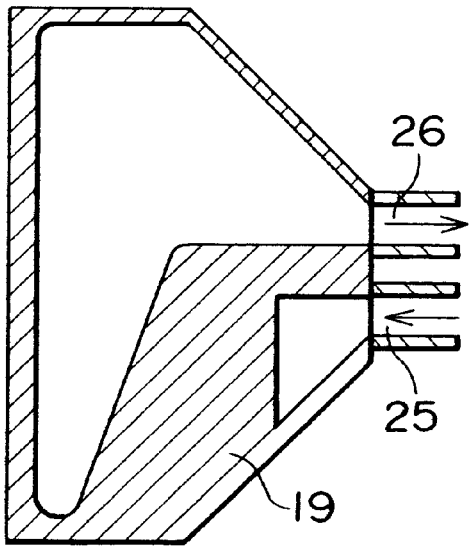

FIG. 10A is a cross-sectional view taken along the line d–d' in FIG. 9A, while FIG. 10B is a cross-sectional view taken along the line e–e' in FIG. 9B. The lid 19 is arranged to have such a structure, so that the ink supplying system and the ink recovering system will be prevented from overlapping with each other. The ink supplying system and the ink recovering system are separately provided at the lower portion and the upper portion of the lid with respect to the dotted line c–c' in FIG. 8 so that the ink flowing path is wider in the width direction at the left side of the head.

The head fabricated as described above has ink jetting units which are arrayed at a wide interval (interval at which the guiding members are arrayed), or 150 to 500 μm, and hence it is difficult to obtain an image of high definition. If the interval of the ink jetting units is made narrower than 150 μm, the electric field distribution of each jetting member is disturbed due to the influence of the pulse voltage applied to an adjacent electrode, in spite of the fact that each ink flowing path is separately formed. Therefore, there is a problem in that the direction in which the ink drop flies is distorted. A method of solving this problem will hereinafter be described with reference to FIG. 7.

Figure 7:
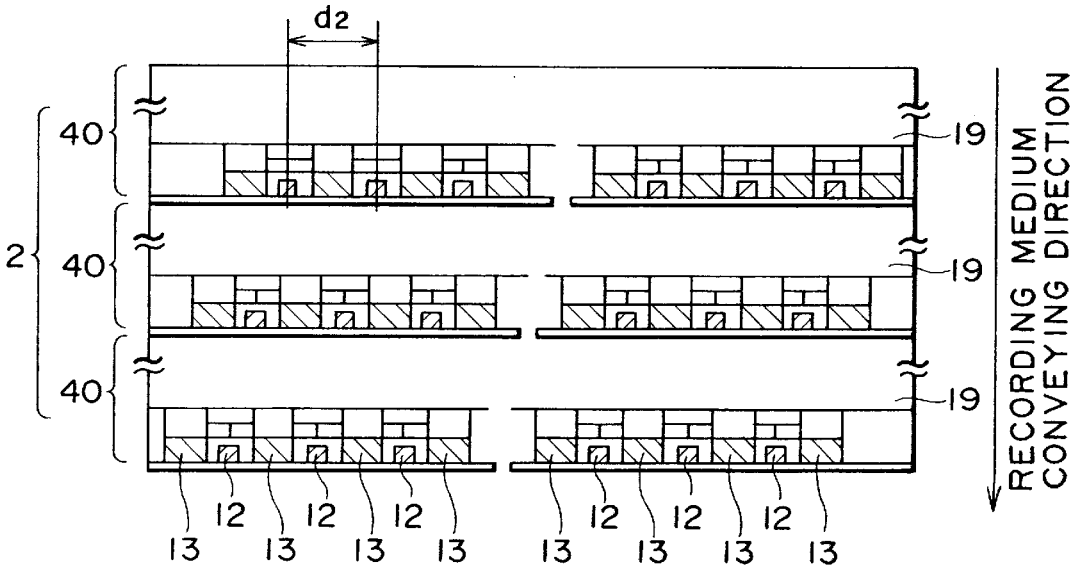
FIG. 7 is a diagram showing another embodiment of a recording head of the ink jet recording apparatus according to the present invention.

FIG. 7 shows an arrangement of line heads in which the line head arrays illustrated in FIG. 1B are stacked on one another to form three steps. Although the illustration contains three steps of arrays, this is merely an example. Therefore, any number n of steps may be provided based on the relation between the desired dot interval d1 and the interval d2 of the jetting member 12. Thus, the interval of the jetting member is given as d2=d1×n. The n-line head arrays are stacked on one another so that the jetting members are disposed in a staggered fashion, whereby dots can be formed at desired pitches in the recording medium feeding direction and the vertical direction, respectively. In this way, the line head arrays are stacked on one another to carry out printing, and an image of high definition can be produced.

Figure 12:
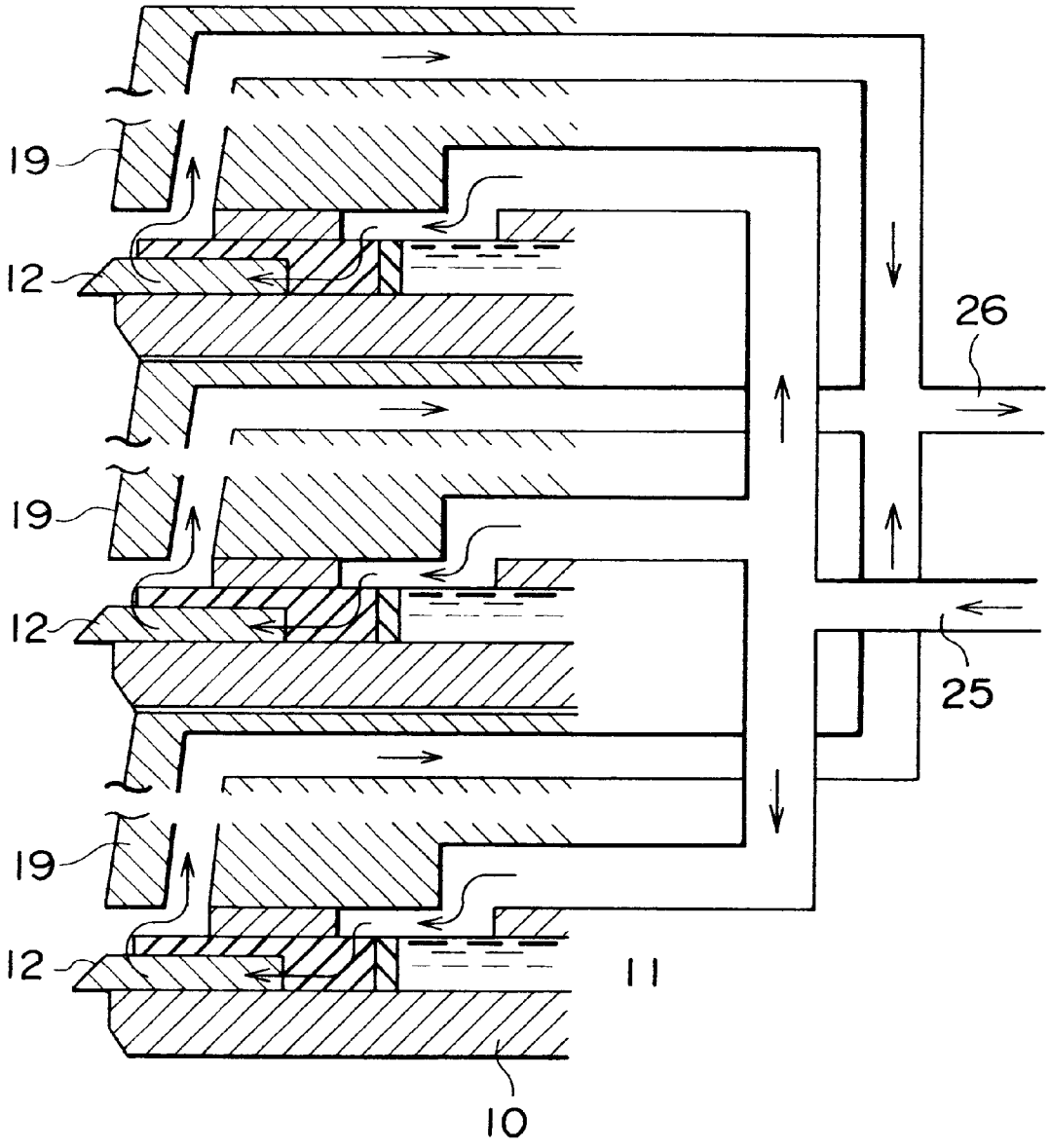
FIG. 12 is a diagram showing a cross-section of another embodiment of the recording head of the ink jet recording apparatus according to the present invention.

How ink is circulated in the arrangement will be described with reference to FIG. 12, which is a lateral cross-sectional view of the line head shown in FIG. 7. The arrangement shown in FIG. 12 corresponds to an arrangement wherein the line head array shown in FIG. 1A is stacked one on another. Ink is circulated in such a manner that ink is supplied from the ink supplying conduit 25 to branch into n-steps for supplying ink to each of the line heads, and ink circulated within each of the line heads is collected so as to be recovered from the conduit 26 of the ink recovering system.

Since the arrangement is as described above, when printing is carried out, dots can be provided at a small interval both in the recording medium feeding direction and in the vertical direction. The dot interval in the recording medium feeding direction can be adjusted by adjusting the dot printing cycle and the recording medium feeding speed. In this way, it becomes possible to realize a recording apparatus which is capable of printing an image of high definition.

According to the present invention, by surrounding each jetting member with a separating wall and by separating the ink flowing path for each channel, the potential applied to the recording electrode of the channel under ink jetting operation can be prevented from being transmitted to the neighboring channel through the ink. For this reason, the channel will not be influenced from the adjacent recording electrode, with the result that the ink jetting direction becomes stable. Accordingly, it becomes possible to record an image of high definition with no disturbance.

Further, ink flows into each separately provided ink flow path from the proximal end of the jetting member to the tip end of the same. Then, the ink is made to have a component for returning to the proximal end of the jetting member before the flying point. Thus, densely concentrated ink is sucked from the tip end of the jetting member into a part of the circulating system. In this way, the tip end of the jetting member is always supplied with new ink, whereby the jetting member can be prevented from being clogged with material of the ink. Since the jetting member can be prevented from being clogged with material of the ink, the ink is jetted in a desired direction and it becomes possible to produce an image of high definition with no disturbance.

Further, by providing recording heads having an ink circulating device in which the ink jetting units are distributed in a staggered fashion and disposed in a multi-step fashion; the number of dots provided per unit area on the recording medium can be increased, with the result that it becomes possible to produce an image of high definition at high speed.

Next, how the voltage to be applied to the recording electrode 11 of the ink jetting member is controlled for the timing of the application will be described. In this case, a description will be made of an example in which ink is jetted only from four continuously arrayed jetting members $\mathbf{12}A_{2i-1}$, $\mathbf{12}A_{2i}$, $\mathbf{12}A_{2i+1}$, $\mathbf{12}A_{2(i+1)}$.

As has been described above, the jetting members 12 of the ink jetting unit 5 are arrayed so that every jetting member is shifted relative to the adjacent members on either side by a positional shift d1 in the feeding direction of the recording medium 7 (see FIG. 1B). Thus, the recording line on the recording medium 7 during feeding is deviated in the time of arrival at the tip end position of the jetting member 12. That is, of the plurality of jetting members 12 arrayed in a column fashion, the jetting member disposed with a positional shift d1 in the feeding direction of the recording medium 7 (in this case, even numbered ink jetting members $\mathbf{12A}_{2i}$, $\mathbf{12A}_{2(i+1)}$) will have an arrival of the recording medium 7 delayed by the shifted amount.

Figure 13:
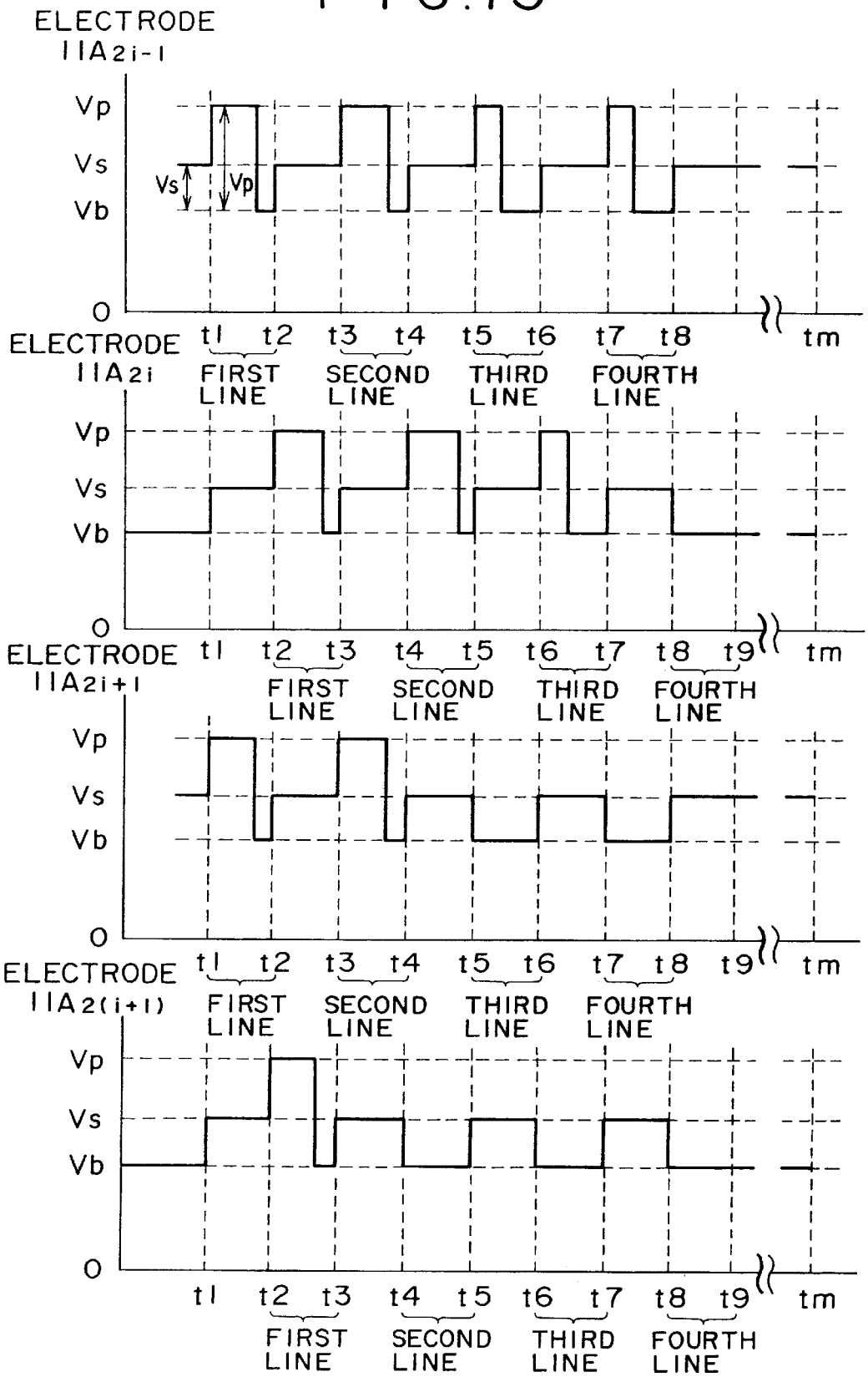
FIG. 13 is a timing chart showing a voltage application timing for each recording electrode according to the present invention.

Thus, recording electrodes $\mathbf{11A}_{2i-1}$, $\mathbf{11A}_{2i}$, $\mathbf{11A}_{2i+1}$, $\mathbf{11A}_{2(i+1)}$ corresponding to the four continuously arrayed jetting members $\mathbf{12A}_{2i-1}$, $\mathbf{12A}_{2i}$, $\mathbf{12A}_{2i+1}$, $\mathbf{12A}_{2(i+1)}$ are supplied with a voltage at the timings shown in FIG. 13.

First, the four jetting members $\mathbf{12A}_{2i-1}$, $\mathbf{112A}_{2i}$, $\mathbf{12A}_{2i+1}$. $\mathbf{12A}_{2(i+1)}$ are supplied with the bias voltage Vp.

The pulse generator 30 connected to the recording electrodes $\mathbf{11A}_{2i-1}$, $\mathbf{11A}_{2i+1}$, corresponding to the odd numbered jetting members $\mathbf{12A}_{2i-1}$, $\mathbf{12A}_{2i+1}$, operates to superimpose a first pulse voltage vs of a predetermined width on the bias voltage Vb (up to $t_1$). In this way, pigment components are drawn toward the tip end of the odd numbered jetting members $\mathbf{12A}_{2i-1}$. $\mathbf{12A}_{2i+1}$.

Figure 14A:
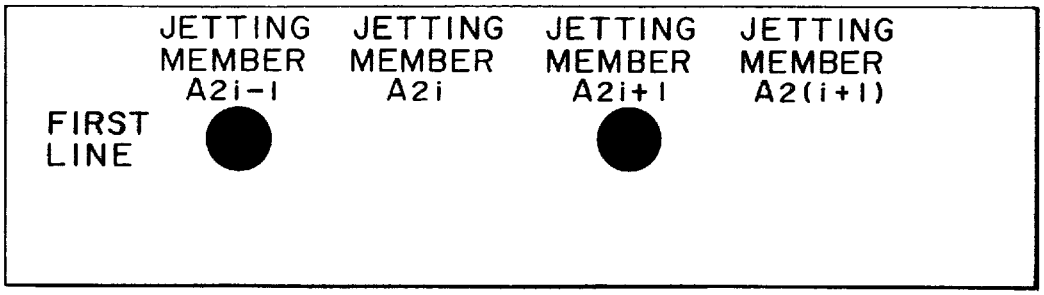
FIG. 14A, FIG. 14B and FIG. 14C are diagrams showing a layout of dots formed on a recording medium when a voltage is applied to each recording electrode in accordance with the timing chart of FIG. 13.

Further, the pulse generator 30 connected to the recording electrodes $\mathbf{11A}_{2i31\ 1}$, $\mathbf{11A}_{2i+1}$ corresponding to the odd numbered jetting members $\mathbf{12A}_{2i-1}$, $\mathbf{12A}_{2i+1}$, operates to superimpose a second pulse voltage vp, which has been pulse-width modulated in accordance with the image signal, on the bias voltage Vb ($t_1$ to $t_2$). In this way, an ink drop containing densely concentrated pigment components will fly from the tip end of the odd numbered jetting members $\mathbf{12A}_{2i-1}$, $\mathbf{12A}_{2i+1}$, whereby dots are formed on the recording line of the recording medium 7 (see FIG. 14A).

During the period of time from $t_1$ to $t_2$, each pulse generator 30 connected to the recording electrodes $\mathbf{11A}_{2i}$, $\mathbf{11A}_{2(i+1)}$, corresponding to the even numbered jetting members $\mathbf{12A}_{2i}$, $\mathbf{12A}_{2(i+1)}$ under suspension, operates to superimpose the first pulse voltage vs of predetermined width on the bias voltage Vb. In this way, pigment components are drawn toward the tip end of the even numbered jetting members $\mathbf{12A}_{2i}$, $\mathbf{12A}_{2(i+1)}$ which are placed under the next jetting duty.

In addition, during the period of time from $t_1$ to $t_2$, the recording medium 7 is fed by a predetermined distance (≈d), and the recording line of the recording medium 7 is positioned forward of the tip end of the even numbered jetting members $\mathbf{12A}_{2i}$, $\mathbf{12A}_{2(i+1)}$ under suspension.

Figure 14B:
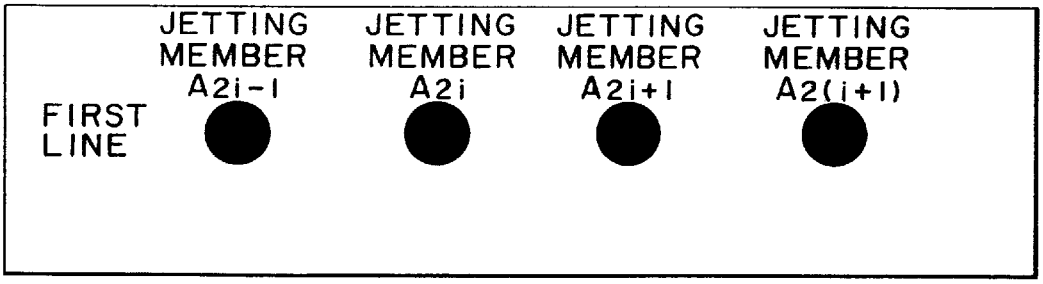

Next, each pulse generator 30 connected to the recording electrodes $\mathbf{11A}_{2i}$, $\mathbf{11A}_{2(i+1)}$, corresponding to the even numbered jetting members $\mathbf{12A}_{2i}$, $\mathbf{12A}_{2(i+1)}$, operates to superimpose the second pulse voltage vp, which has been pulse-width modulation in accordance with the image signal, on the bias voltage Vb ($t_2$ to $t_3$). In this way, an ink drop containing densely concentrated pigment components will fly from the tip end of the even numbered jetting members $\mathbf{12A}_{2i}$, $\mathbf{12A}_{2(i+1)}$, whereby new dots are formed between dots which have been already formed on the recording line of the recording medium 7 (see FIG. 14B). Thus, picture recording of one line amount is completed on the recording medium 7.

During the period of time from $t_2$ to $t_3$, each pulse generator 30 connected to the recording electrodes $\mathbf{11A}_{2i-1}$, $\mathbf{11A}_{2i+1}$, corresponding to the odd numbered jetting members $\mathbf{12A}_{2i-1}$, $\mathbf{12A}_{2i+1}$ under suspension, operates to superimpose the first pulse voltage vs of predetermined width on the bias voltage Vb. In this way, pigment components are drawn toward the tip end of the odd numbered jetting members $\mathbf{12A}_{2i-1}$, $\mathbf{12A}_{2i+1}$ which are placed under the next jetting duty.

When the recording medium 7 is fed during the period of time from $t_2$ to $t_3$, and the next recording line of the recording medium 7 is positioned at the front tip end of the odd numbered jetting members $\mathbf{12A}_{2i-1}$, $\mathbf{12A}_{2i+1}$ under suspension, the image for the next line is recorded on the recording medium 7. If the recording line contains a region on which a dot is prohibited from being formed, the recording electrode (in this case, recording electrode $\mathbf{11A}_{2(i+1)}$) corresponding to the jetting member to be positioned in the region is supplied with the bias voltage after the first pulse voltage is applied thereto. Thus, pigment components left near the tip end of the jetting member, which has not been jetted, can be recovered by the flow of ink described above. In this way, the jetting member, from which ink has not been jetted, can be prevented from having a color agent component adhere at the tip end thereof, with the result that the image formed on the receding medium can be prevented from being distorted.

Figure 14C:
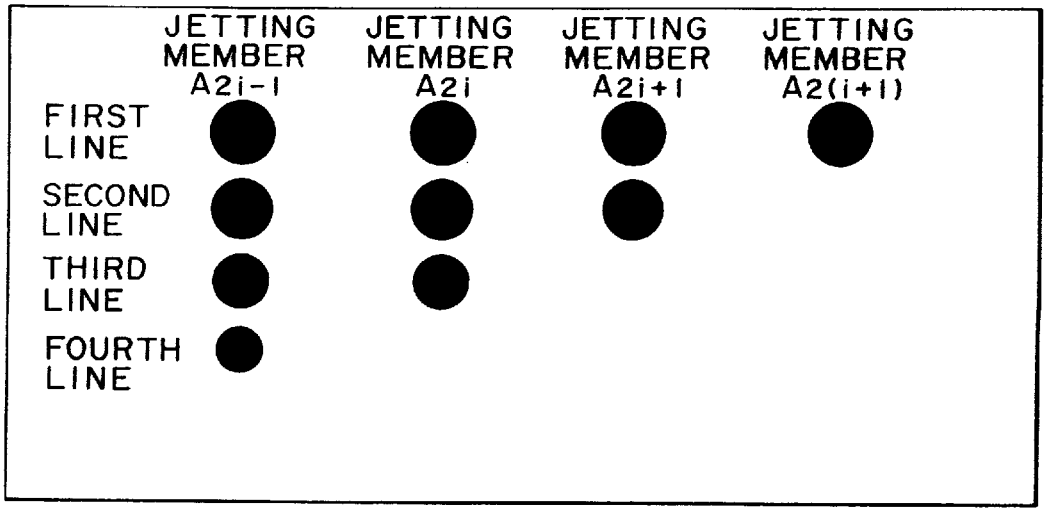
Figure 150:
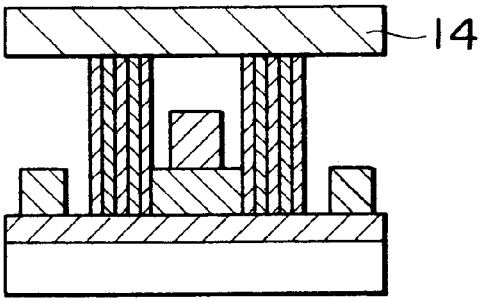
Figure 150:
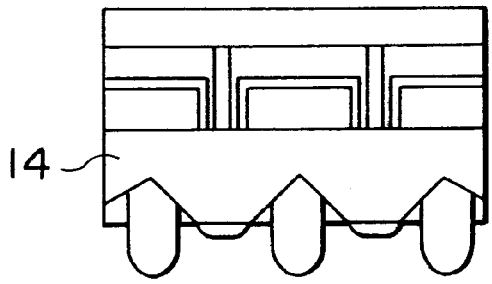

When voltage application based on the timing chart of FIG. 13 is completed, dots shown in FIG. 14C are recorded on the recording medium 7.

As described above, when a certain jetting member of a plurality of jetting members arrayed in a column fashion is controlled to perform an ink drop jetting operation, the jetting members positioned on both the sides of the jetting member performing the jetting operation are necessarily not controlled to perform ink drop jetting. For this reason, it becomes possible to eliminate cross talk which can disturb the symmetry of the electric field concerning the jetting member engaged in an ink drop jetting operation. Therefore, the locus of ink drops jetted from any jetting member can be protected from being distorted toward either of the neighboring jetting members, and the image formed on the recording medium can be prevented from being deteriorated.

Meanwhile, according to the present embodiment, pigment components left near the tip end of the jetting member are recovered by the ink flow, whereby the jetting member can be prevented from having pigment components which trigger clogging adhere thereto. However, if the printing operation is performed for a long time, the jetting member may tend to have a pigment component adhere near the tip end thereof. Under the condition that the recording apparatus is driven for a long period of time, if it is desired to protect the jetting member from having pigment material adhere near the tip end thereof, application of a voltage to the recording electrode may be periodically interrupted during printing. Where the recording electrode is periodically brought into a ground condition, then the color agent component left near the tip end of the jetting member is again dispersed into the ink and is recovered together with the aforementioned recovered ink flow into the ink recovering system.

Further, according to the present embodiment, ink is jetted from an oblique upper direction with respect to the recording medium. However, such arrangement is not indispensable. That is, ink may be jetted in any direction with respect to the recording medium so long as the projecting amount of the separating wall relative to the head substrate and the projecting amount of the jetting member relative to the separating wall fall within the range described above.

While the above description has been made for an example of an ink jet recording apparatus for monochrome printing, if it is desired to realize an ink jet recording apparatus for color-printing, a recording head with the same arrangement is mounted for each color (i.e., for cyan, magenta, yellow and black).

Finally, a method of fabricating the ink jetting unit 5 of the recording head will be described with reference to FIGS. 15A(1) to 15O(2).

(a) Initially, as seen in FIGS. 15A(1) and 15A(2), a groove 100 is formed on the head substrate 10 made of a low permittivity insulating material (e.g., glass) having a thickness of about 1 mm, by using a dicing saw or the like. The groove 100 may be formed to have a width $L_2$ 0.2 mm to 0.5 mm and a depth $L_1$ of about 0.2 mm. However, it is necessary for the length $L_3$ thereof to be longer than the lateral width of the line head.

(b) Next, as seen in FIGS. 15B(1) and 15B(2), a polyimide sheet 101 having a thickness of about 20 $\mu$m is coated on the head substrate 10 by thermocompression. Further, an Ni—Cr film 102 having a thickness of about 0.5 $\mu$m is formed thereon by spattering or the like.

(c) Next, as seen in FIGS. 15C(1) and 15C(2), the Ni—Cr film 102 is coated with a photoresist material so that a photoresist film is formed on the Ni—Cr film 102. The photoresist film is exposed under light irradiation through a photomask which is formed to have a predetermined electrode pattern. The photoresist film is developed to form a photoresist pattern on the Ni—Cr film 102. Then, the Ni—Cr film 102 is subjected to etching with the photoresist pattern thus produced used as a mask. Thus, an underlying metal pattern 103, which is utilized when the recording electrode is formed by an electroforming process (1) is formed on the polyimide sheet 101.

(d) Next, as seen in FIGS. 15D(1) and 15D(2), a polyimide sheet 104 having a thickness of about 20 to 30 $\mu$m is covered over the underlying metal pattern 103 so that the polyimide sheet 104 is adhered to the polyimide sheet 101 or the like by thermocompression. Further, a metal film 105 (Al, Cu or the like) having a thickness of about 2 $\mu$m is formed thereon.

(e) Next, as seen in FIGS. 15E(1) and 15E(2), the metal film 105 is coated with a photoresist so that a photoresist pattern is formed on the metal film 105 by photolithography similar to that described in the step (c). Then, the metal film 105 is subjected to etching with the photoresist pattern used as a mask.

Thus, a mask pattern 106 for forming the jetting member and a mask pattern 107 for forming the step for giving a positional shift to the jetting members are formed on the polyimide sheet 104.

(f) Next, as seen in FIGS. 15F(1) and 15F(2), a polyimide sheet 108 having a thickness of about 20 to 30 $\mu$m is covered over the mask patterns 106, 107 so that the polyimide sheet 108 is adhered to the polyimide sheet 104 or the like by thermocompression. Further, a metal film 109 (Al, Cu or the like) of a thickness of about 2 $\mu$m is formed thereon.

(g) Next, as seen in FIGS. 15G(1) and 15G(2), photolithography and etching processes similar to those in the above-described step (e) are carried out to form a mask pattern 110 on the layer of polyimide sheet 108. A dry etching of step (j), which will be described later, using the mask pattern 110 as a mask will be carried out so that the layer of the polyimide sheet 108 is contoured into the shape of the ink jetting member.

(h) Next, as seen in FIGS. 15H(1) and 15H(2), a polyimide sheet 111 having a thickness of about 40 to 50 $\mu$mis covered over the mask pattern 110 to adhere it to the polyimide sheet 108 or the like by thermocompression. Further, a metal film 112 (Al, Cu or the like) having a thickness of about 2 $\mu$m is formed thereon.

(i) Next, as seen in FIGS. 15I(1) and 15I(2), photolithography and etching processes similar to those in the above-described step (e) are carried out to form a mask pattern 113 on the layer of polyimide sheet 111. The dry etching of the following step (j), which will be described next, using the mask pattern 113 as a mask will be carried out so that the layer of the polyimide sheet 111 is contoured into the shape of the ink jetting member.

(j) Next, as seen in FIGS. 15J(1) and 15H(2), the polyimide sheets 111, 108, 101 are subjected to dry etching with the mask patterns 113, 106, 107, 110 used as a mask. (k) Next, as seen in FIGS. 15K(1) and 15K(2), the mask patterns 113, 106, 107, 110 exposed due to the dry etching effected on the polyimide sheets 111, 108, 101 are removed. Thus, the separating wall 13 and the jetting member 12 are formed.

(l) Then, as seen in FIGS. 15L(1) and 15L(2), a layer of Ni is deposited on the underlying metal pattern 103 by electroforming. Thus, the recording electrode 11 is formed within the separating wall 13.

(m) Next, as seen in FIGS. 15M(1) and 15M(2), a polyimide sheet 114 of a thickness having about 20 $\mu$m is pressed on the upper f ace of the separating wall 13. Further, a metal film 115 (Al, Cu or the like) having a thickness of about 2 $\mu$m is formed thereon. Thereafter, photolithography and etching processes similar to those in the above-described step (e) are carried out to form a mask pattern on the layer of polyimide sheet 114.

(n) Next, as seen in FIGS. 15N(1) and 15N(2), the polyimide sheet 114 is subjected to the dry etching with the mask pattern 115 used as a mask. In this way, an upper side insulating layer 14 having a V-letter shape notch and an ink supplying inlet is formed.

(o) Next, a groove is formed on the back face of the head substrate 10 by a dicing saw or the like so that the groove corresponds to the groove 100 on the front face. Thereafter, the part of the head substrate 10 is removed by breaking the substrate along the bottom line of a couple of grooves. The face from which the part of the substrate is removed is grounded to form a slant face. In this way, the tip end of the jetting member and the separating wall are made to project from the edge of the head substrate 10 by a proper amount, as seen in FIGS. 15O(1) and 15O(2). Finally, a lid 19 with which an ink recovering path is formed is attached on the head substrate 10. Thus, the ink jetting unit 5 of the recording head of FIG. 1 is completed. When the recording head of FIG. 7 is fabricated, the head substrates 10 having the lid 19 attached thereon are stacked on one another so that the positions of the jetting members are shifted relative to each other in the in-plane direction between at least neighboring upper and lower head substrates. Thus, the recording head of FIG. 7 is completed.

According to the above arrangement and the manufacturing method thereof, it becomes possible to prevent the recording electrode from being clogged with ink material adhering at the tip end thereof, and the locus of the ink drop jetted from the recording head can be prevented from being deviated due to a deviation in the jetting point on the jetting member. Accordingly, it becomes possible to provide an ink jet recording apparatus which is capable of printing an image with a high definition.

While a preferred embodiment of the present invention has been described using specific terms, such description is for illustrative purpose only, and it is to be understood that changes and variations may be made without departing from the spirit or scope of the invention as defined in the following claims.

What is claimed is:

1. An ink jet recording head comprising:

a substrate;

a jetting member disposed on said substrate and having a proximal tip end from which ink is jetted;

a recording electrode, disposed so as to sandwich said jetting member, for making ink jet from said jetting member; and a covering member for covering the recording electrode, wherein said ink is supplied from the proximal tip end of said jetting member and is recovered in an upward direction from near the tip end of the jetting member.

2. An ink jet recording head according to claim 1, wherein the height of the covering member is larger than the height of said jetting member.

3. An ink jet recording head according to claim 1 or claim 2, wherein the flow path for recovering ink from near the tip end of said jetting member has a V-letter shaped inlet.

4. An ink jet recording head comprising:

a substrate;

a jetting member disposed on said substrate and having a tip end from which ink is jetted;

a recording electrode, disposed so as to sandwich said jetting member, for making ink jet from said jetting member;

a covering member for covering the recording electrode;

an ink supplying path for supplying ink to the jetting member; and an ink recovering path for recovering ink from near the tip end of the jetting member, wherein the ink supplying path and the ink recovering path are formed to be gradually narrower as viewed in cross-section, as they come to closer to the jetting member.

5. An ink jet recording apparatus comprising: a recording head having a substrate, a jetting member disposed on said substrate, a recording electrode, disposed so as to sandwich said jetting member, for making ink jet from the jetting member, a covering member for covering the recording electrode, a circulating unit for circulating said ink, and an ink chamber for reserving said ink therein;

a common electrode disposed so as to oppose the jetting member; and a feeding path for feeding a recording medium.

6. An ink jet recording apparatus according to claim 5, wherein said recording head is composed of several arrays of said jetting members stacked on one another, each array of said jetting members being shifted relative to one another to form a staggered arrangement.

* * * * *